US005353732A

United States Patent [19]

Gramet et al.

[11] Patent Number: 5,353,732

[45] Date of Patent: Oct. 11, 1994

[54] ANCHOR FOR HEAVY LOADS

[75] Inventors: Jean C. Gramet, La Turbie; Samy Alhayari, Menton, both of France

[73] Assignee: Single Buoy Moorings Inc., Marly, Switzerland

[21] Appl. No.: 144,534

[22] Filed: Nov. 2, 1993

[30] Foreign Application Priority Data

Nov. 2, 1992 [EP] European Pat. Off. ..... 92203370

[51] Int. Cl.[5] ..... B63B 21/32

[52] U.S. Cl. ..... 114/304

[58] Field of Search ..... 114/294, 301-306

[56] References Cited

U.S. PATENT DOCUMENTS

| | | | |
|---|---|---|---|
| 2,490,423 | 12/1949 | Fearn . | |
| 3,022,762 | 2/1962 | Hillcourt . | |
| 3,822,664 | 7/1974 | Hedman . | |
| 4,397,256 | 8/1983 | Bruce | 114/303 |
| 4,781,142 | 11/1988 | Cheung | 114/304 |
| 4,802,434 | 2/1989 | Bruce | 114/294 |
| 4,856,451 | 8/1989 | Bruce | 114/301 |
| 4,995,326 | 2/1991 | Van den Haak | 114/301 |

FOREIGN PATENT DOCUMENTS

| | | |
|---|---|---|
| 1084348 | 8/1980 | Canada . |
| 0020152 | 12/1980 | European Pat. Off. . |
| 0049544 | 2/1986 | European Pat. Off. . |
| 0220758 | 5/1987 | European Pat. Off. . |
| 2082722 | 12/1971 | France . |
| 2126768 | 10/1972 | France . |
| 2294080 | 7/1976 | France . |
| 2366987 | 5/1978 | France . |
| 7115016 | 5/1973 | Netherlands . |
| 7608728 | 2/1978 | Netherlands . |
| 1390790 | 4/1975 | United Kingdom . |
| 2011331 | 7/1979 | United Kingdom . |
| 2035242 | 6/1980 | United Kingdom . |
| 1584196 | 2/1981 | United Kingdom . |
| WO 85/05084 | 11/1985 | World Int. Prop. O. . |
| WO 87/01347 | 3/1987 | World Int. Prop. O. . |

*Primary Examiner*—Jesus D. Sotelo

*Attorney, Agent, or Firm*—Young & Thompson

[57] ABSTRACT

An anchor has a fluke (3) having an underside (2) lying in one flat geometrical plane and comprising two fluke parts (5, 6) which each have a forwardly pointed tip (7, 8) on either side of the central plane (9) of symmetry which is perpendicular to the geometrical plane (2) of the underside. These two fluke parts (5, 6) form an integral unit at the central plane (9) and have their front edges (10, 11, 12, 13) in that geometrical plane (2) tapering towards the respective tips (7, 8) and from each tip (7, 8) extend rearwardly with a cross section in each plane perpendicular to the underside plane (2) and perpendicular to the plane (9) of symmetry. That unit is substantially triangular up to and beyond the point where the inner front edges (11, 12) of the fluke parts (5, 6) meet, which triangular cross sections (10, 11, 12, 13) have their apex (22, 23) according to a straight ridge line which from each tip (7, 8) extends rearwardly at a sharp angle ($\alpha$) with the underside plane (2). The triangular cross sections merge into each other at the central plane of symmetry. The fluke (3) has adjustably connected therewith a shank (14) which by a transfer pin (15) and a spaced-apart adjustable point of connection (16) can be placed at a predetermined sharp angle with respect to the plane (2) of the underside. The entire fluke (3) has a box-like structure in that the plane (2) at the underside is formed by a flat plate (2).

2 Claims, 2 Drawing Sheets

ANCHOR FOR HEAVY LOADS

DESCRIPTION OF THE PRIOR ART

The present invention relates to an anchor with a fluke having an underside lying in one flat geometrical plane and comprising two fluke parts which each have a forwardly pointed tip on either side of the central plane of symmetry which is perpendicular to the said geometrical plane of the underside, which two fluke parts form an integral unit at the said central plane, have their front edges in said geometrical plane tapering towards the respective tips and from each tip extend rearwardly with a cross section in each plane perpendicular to the said underside plane and perpendicular to said plane of symmetry, which is substantially triangular up to and beyond the point where the inner front edges of the fluke parts meet, which triangular cross sections have their apex according to a straight ridge line which from each tip extends rearwardly at a sharp angle with the underside plane, whilst said triangular cross sections merge into each other at said central plane of symmetry, which fluke has adjustably connected therewith a shank which by means of a transfer spin and a spaced apart adjustable point of connection can be placed at a predetermined sharp angle with respect to said plane of the underside.

An anchor of this type is known from U.S. Pat. No. 4,781,142.

Said known anchor has a fluke with two fluke parts each of which in a transverse plane do have a substantially triangular cross section which is open at the bottom. Said fluke parts are internally provided with reinforcing ribs which extend up to the underside plane. Accordingly the lower edges of said reinforcing ribs are exposed at the underside and form an open cell structure, which under normal circumstances will not hamper the penetration of the fluke into the soil but can give additional resistance upon withdrawal of the anchor. Said reinforcing ribs have to be very strong to give strength to the fluke parts because of their open structure.

Said known anchor has only a single shank which has a pivotable point of connection in its rear half of the fluke and an adjustable point of connection close to the rear end of the fluke. Said shank is placed in the central plane of symmetry but if the anchor yaws or roles due to being subjected to unequally distributed loads, such shank and its points of connection are heavely loaded.

Said heavy loads have to be taken up by the structure of the flukes or fluke parts.

Anchors can be subjected to very heavy loads from almost any direction. When they are lowered upon the sea bottom, in particular when they are dropped, sudden loads can occur when they hit the bottom or obstacles. Upon reaching said bottom they are not oriented in the proper position nor in the proper direction for becoming dug in the soil and deliver anchoring forces. Very often they have to be turned over during being dragged over the soil of the bottom, can meet obstacles, stones rock and the like and when they have reached the proper position to start digging in the fluke parts often meet unequal resistances.

If there is only a single shank the two fluke parts of the above-mentioned prior art anchor will generate heaving bending forces there where the two fluke parts merge into each other which is at and adjacent to the said central plane of symmetry. This makes it necessary to provide reinforcing ribs in different directions.

The substantially triangular cross section of the fluke parts have the advantage that once properly being dug into the soil the laterally inclined top faces enlarge the area of the soil above the anchor against which the anchor finds support.

The construction of said known anchor is however extremely complicated due to the presence of the reinforcing Fibs and does not have the possibility to add additional weight.

It is observed that from EP-A-0,049,544 an anchor is known having a double shank. Said double shank is connected, if so desired, adjustable with a fluke formed by a single flat plate.

The two shank arms have connecting points with said fluke plate which are spaced apart and lie at equal distances from the central plane of symmetry and extend towards each other from the fluke towards a single point of connection in a manner such that they form between them a sharp angle. When said anchor is dug into the soil the flat top surface of the fluke does not enlarge the mass of soil against which the fluke finds support. However if the shank arms are sufficiently deep due in their inclined outer faces will help in somewhat increasing the lateral area of support although they mainly are present in a portion of the soil which has been disturbed by the anchor upon being dug in. Although a shank has two arms connected at spaced apart locations with the fluke all bending forces have to be taken up by the plate which forms the fluke and in particular at the points of connection between fluke arms and plate.

OBJECT OF THE INVENTION

Purpose of the invention is to provide an anchor which is simple of construction, nevertheless extremely strong, allows excellent penetration of fluke and shank and optimal distribution of load transfer between shank and fluke as well as generating a broad load bearing mass above the anchor when dug in.

SHORT DESCRIPTION OF THE INVENTION

According to the invention this purpose is achieved in that the entire fluke has a box-like structure in that the plane at the underside is formed by a flat plate, that at the top ridge of each box-like structure part of substantially triangular cross section at least one vertical ridge plate has been secured, and that the shank is a double shank the two arms of which are interconnected at their front ends and from said front ends extend towards the top ridges of each fluke part, have their pivotable points of connection by means of said transfer pin between one third and two thirds of each ridge away from the tip and have their adjustable points of connection between two thirds and the rear end of said ridge, each of said arms having a rear part which curves downwardly towards said points of connection and which lie in planes parallel to each other and to the said central plane of symmetry, whereas the forwardly extending parts of said arms, between said rear parts and the interconnected front ends each extend in a plane, which forms a sharp angle with respect to said plane of symmetry and which meet each other at the front end connection according to the double of said sharp angle, and that the two arms of the shank are interconnected with each other at the transition between each rear part and the front parts by a flat plate which lies in a plane which is substantially parallel to the plane of the ridges.

By providing the fluke with a flat bottom plate a box-like structure is obtained which in itself due to the triangular cross sections of the respective fluke parts has already large strength. Moreover said flat bottom plate offer resistance upon withdrawal of the anchor.

Such a box-like structure can be hollow but should of course not provide an empty space which generation buoyancy. If desired reinforcing ribs can be present inside said box-like structure but it also can be filled up with a mass enlarging substance such as concrete or heavy metal.

The shank is a double shank of a particular shape. Its points of connection are at the ridges of the two fluke parts and this is the best place of connection for transferring loads to the box-like structures of the fluke parts because the loads are transferred at the tops of the triangular cross section due to which bending forces and tension forces can be taken up more efficiently than would be the case if the arm of a shank or the arms of a double shank would have been connected to a flat top plate. A tension force acting on a flat plate in a direction perpendicular to the plane of said plate starts to bend said plate because the point of engagement of the force is away from the edges of the plate which do not follow and this means that the force components of the tension force in a direction of the plane of the flat plate are extremely large. A connection at the top ridge of a triangular box is considerably more favourable in respect of distribution of bending and tension forces.

The double shank has, starting at the ridges of the two fluke parts, rear portions which are curved upwardly and lie in parallel planes parallel to the plane of symmetry. This means that during penetration into the soil the soil can easily pass through the space between said shank parts without generating bending forces in transverse direction on said shank parts and accordingly without loading the connection of the shank arms at the ridges of the fluke parts by forces other than the tension forces.

Only in the front part of the shank arms the arms are bend into planes which include a sharp angle and at the transition between said rear parts and said front parts the two shank arms can be interconnected by a flat transverse plate lying in the plane which is substantially parallel to the plane of the ridges. If such a transverse plane is present bending forces resulting from the tension at the front end of the shank are taken up by said transverse plate. If said plate is not present bending forces gradually are dissipated towards the top regions of the parallel rear ends of the shank arms.

The front parts of the shank arms, due to the fact that the rear parts are in parallel planes and at the point of connection of said ends they are also parallel or in the plane of symmetry, the descriptive lines of the front parts are also parallel to each other so that during penetration soil can easily pass. However, once the anchor is dug in sufficiently deep such that the front parts are also deep into the soil said front parts, due to the inclined position of the flukes and accordingly of the shank increase the area within which the front parts of the shank arms find support against the mass of soil above them.

The combination of features of the anchor according to the invention allows for optimal transfer of loads which occur in the entire construction, allows for optimal penetration into the soil. Said combination of features cannot be obtained with the above discussed prior art anchors because if a double shank would be combined with the anchor having two fluke parts, said fluke would still be of open structure whereas if a shank with two shank arms would be connected to a box-like structure having a flat top plate then high-tension forces and accordingly sheering forces cannot be avoided at the connection area of the shank parts with said top plate.

The invention now will be further described with reference to the drawing which in FIG. 1 in perspective view shows one embodiment of the anchor according to the present invention, and in FIG. 2 the rear view of an alternative.

DETAILED DESCRIPTION OF THE INVENTION

Figure 1:
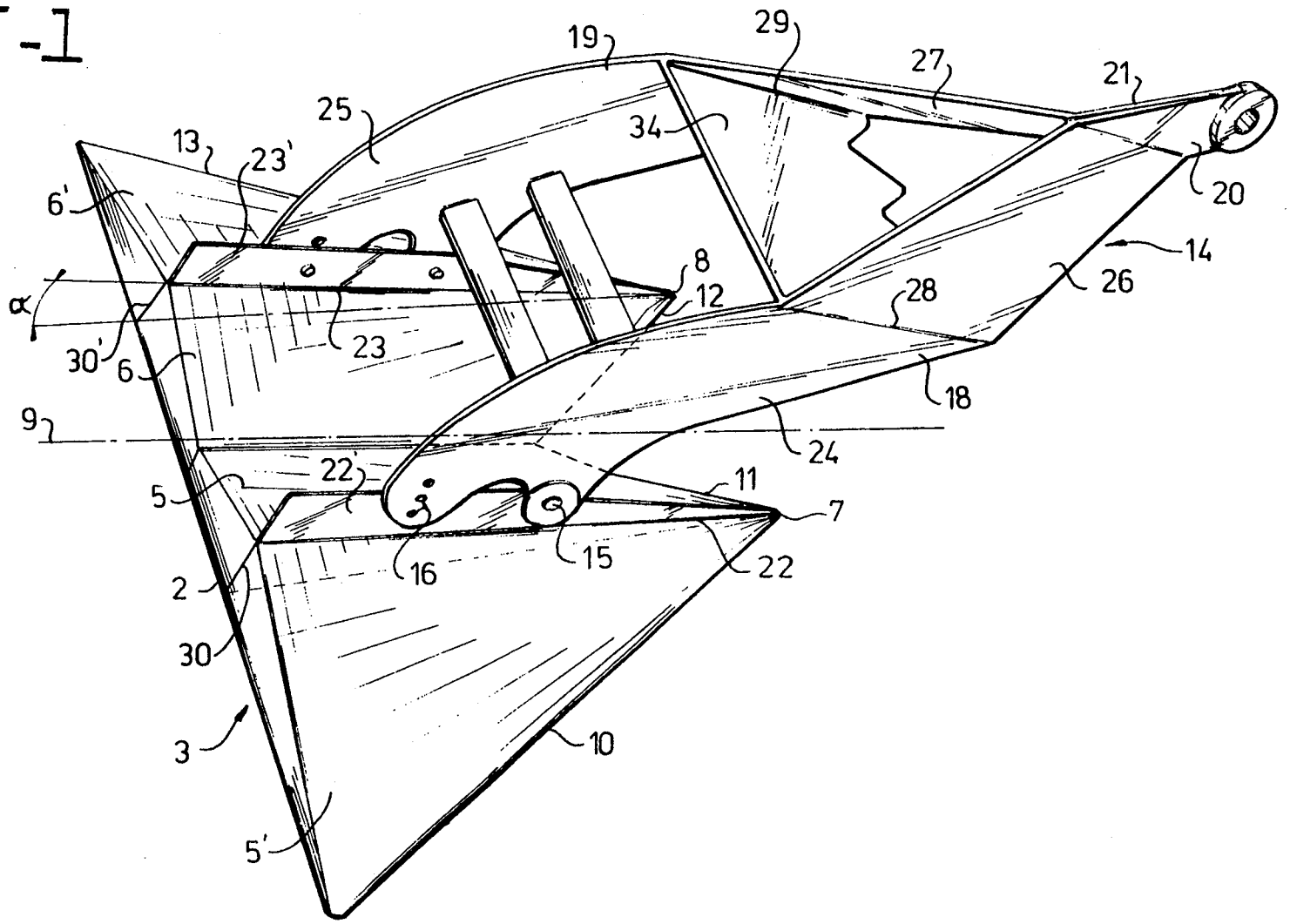

The drawing shows an anchor having a fluke 3 with two fluke parts 5, 6. Said fluke parts are interconnected at the central plane schematically indicated with the interrupted line 9.

The fluke has a bottom plate 2 which is completely flat, has top plates 5, 5' and 6, 6' respectively which top plates at each fluke part in a transverse direction form with the bottom plate 2 a substantially triangular cross section cut off at the central plane 9 where the top walls 5 and 6 respectively merge into each other. A vertical rib can be provided there interconnecting bottom plate and top plates. Said two fluke parts 5, 6, 5', 6' and 2 form an integral unit and each have a forwardly tapering tip one tip 7 being defined by the tapering edges 10 and 11 and the other 8 being defined by the tapering edges 12, 13. The inner edges 11 and 12 meet each other at the said central plane.

The bottom plate 2 and the top plates 5, 5', 6, 6' form a box-like structure which can be closed at the rear side or even can be open, can be filled with a heavy mass such as concrete.

The top plates 5, 5' and 6, 6' respectively form ridges 22 and 23 respectively at which in the embodiment shown vertical plates 22' and 23' are welded. Below said vertical ridge plates there may be a rib 30, 30'.

The anchor shown has a shank generally indicated with 14 having two shank arms 18 and 19 each having a rear part 24 or 25 respectively and a front part 26 or 27 respectively. Said front parts meet each other at 20 and 21 and are interconnected there and have an opening for the attachment of a chain or the like. The rear parts 24, 25 extend parallel to each other and parallel to the central plane of symmetry. They have each a pivotable point of connection such as 15 and an adjustable point of connection such as 16. The point of connection 15 lies between one third and two thirds of the length of ridge 22 and the adjustable point of connection between two thirds and the end of ridge 22, seen from the tip 7 or 8 respectively rearwardly. Said position is the best position for transferring load into the ridge part of the box-like structures.

Between said parallel rear parts 24 and 25 stiffening ribs can be present but preferably a stiffening plate 34 is provided at the transition 28 and 29 respectively between the rear parts 24 and 25 and the front parts 26 and 27 respectively. Said plate 34 may have cutting teeth. Since lines 28 and 29 are parallel to each other and so are the lines where the front ends meet at 20 and 21 all descriptive lines of the front parts 26 and 27 are parallel to each other and substantially parallel to the ridges 22, 23.

Accordingly the opening between the shank arms offers no resistance to the soil which in the drawing from right to left has two parts through the space between the shank arms.

Once the anchor is penetrated its bottom plate 2 extends at a sharp angle with the horizontal and this means that the shank 14 as a whole is tilted to the right due to which the outer faces of the front parts 26 and 27 will add a contributional resistance against withdrawal of the anchor to the resistance generated by the fluke parts.

Figure 2:
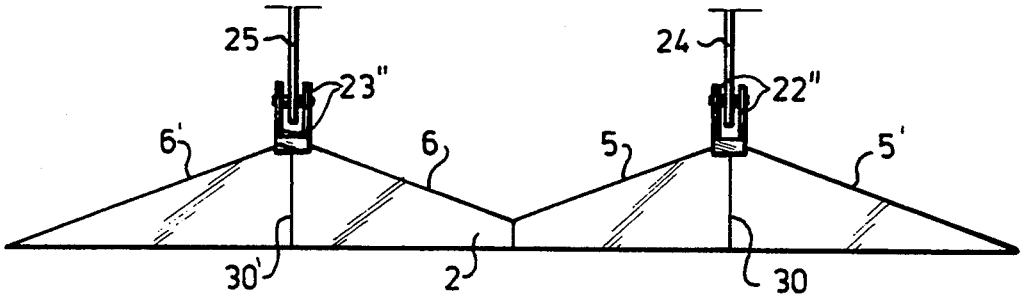

FIG. 2 discloses a rear view of an embodiment which differs from FIG. 1 only in that the ridge plates each are double plates 22'' and 23'' between which the arms 24 and 25 respectively are located.

We claim:

1. Anchor with a fluke (3) having an underside (2) lying in one flat geometrical plane and comprising two fluke parts (5, 6) which each have a forwardly pointed tip (7, 8) on either side of the central plane (9) of symmetry which is perpendicular to the said geometrical plane (2) of the underside, which two fluke parts (5, 6) form an integral unit at the said central plane (9), have their front edges (10, 11, 12, 13) in said geometrical plane (2) tapering towards the respective tips (7, 8) and from each tip (7, 8) extend rearwardly with a cross section in each plane perpendicular to the said underside plane (2) and perpendicular to said plane (9) of symmetry, which is substantially triangular up to and beyond the point where the inner front edges (11, 12) of the fluke parts (5, 6) meet, which triangular cross sections (10, 11, 12, 13) have their apex (22, 23) according to a straight ridge line which from each tip (7, 8) extends rearwardly at a sharp angle ($\alpha$) with the underside plane (2), whilst said triangular cross sections merge into each other at said central plane of symmetry, which fluke (3) has adjustably connected therewith a shank (14) which by means of a transfer pin (15) and a spaced apart adjustable point of connection (16) can be placed at a predetermined sharp angle with respect to said plane (2) of the underside, characterized in that, the entire fluke (3) has a box-like structure in that the plane (2) at the underside is formed by a flat plate (2), that at the top ridge of each box-like structure part of substantially triangular cross section at least one vertical ridge plate (22', 23') has been secured, and that the shank (14) is a double shank i the two arms (18, 19) of which are interconnected at their front ends (20, 21) and from said front ends (20, 21) extend towards the top ridges (22, 23) of each fluke part (18, 19), have their pivotable points of connection by means of said transfer pin (15) between one third and two thirds of each ridge (22, 23) away from the tip (7, 8) and have their adjustable points of connection (16) between two thirds and the rear end of said ridge (22, 23), each of said arms (18, 19) having a rear part (24, 25) which curves downwardly towards said points (15, 16) of connection and which lie in planes parallel to each other and to the said central plane (9) of symmetry, whereas the forwardly extending parts (26, 27) of said arms (18, 19), between said rear parts (24, 25) and the interconnected front ends (20, 21) each extend in a plane, which forms a sharp angle with respect to said plane (9) of symmetry and which meet each other at the front end connection according to the double of said sharp angles and that the two arms (18, 19) of the shank (14) are interconnected with each other at the transition between each rear part (24, 25) and the front parts (26, 27) by a flat plate (34) which lies in a plane which is substantially parallel to the plane (2) of the ridges (22, 23).

2. Anchor according to claim i wherein each ridge plate (22', 23') is a double ridge plate set (22'', 23'') each receiving a shank arm (18, 19) in between.

* * * * *